US007495572B1

(12) United States Patent
Wallach

(10) Patent No.: US 7,495,572 B1
(45) Date of Patent: Feb. 24, 2009

(54) SMART SENSOR SYSTEMS—SWIMMER DETECTION

(75) Inventor: Morton L. Wallach, Groton, CT (US)

(73) Assignee: Pel Associates, Groton, CT (US)

( * ) Notice: Subject to any disclaimer, the term of this patent is extended or adjusted under 35 U.S.C. 154(b) by 0 days.

(21) Appl. No.: 11/769,462

(22) Filed: Jun. 27, 2007

Related U.S. Application Data

(62) Division of application No. 11/056,023, filed on Feb. 11, 2005, now Pat. No. 7,345,596.

(60) Provisional application No. 60/543,953, filed on Feb. 12, 2004, provisional application No. 60/599,141, filed on Aug. 5, 2004.

(51) Int. Cl.
*G08B 21/00* (2006.01)

(52) U.S. Cl. ..... 340/627; 340/572.1; 340/572.6; 340/573.1; 340/573.6; 367/903

(58) Field of Classification Search ..... 340/627, 340/572.1–572.6, 573.1–573.6; 367/903
See application file for complete search history.

(56) References Cited

U.S. PATENT DOCUMENTS

| | | | | |
|---|---|---|---|---|
| 4,846,548 | A | 7/1989 | Klainer | |
| 4,862,146 | A | 8/1989 | McCoy et al. | |
| 5,489,536 | A | 2/1996 | Ekechukwu | |
| 6,130,615 | A * | 10/2000 | Poteet | 340/573.6 |
| 6,215,231 | B1 | 4/2001 | Newnham et al. | |
| 7,218,235 | B1 * | 5/2007 | Rainey | 340/573.6 |
| 7,345,596 | B2 * | 3/2008 | Wallach et al. | 340/984 |

OTHER PUBLICATIONS

"Coating Methods", Kirk-Othner, Encyclopedia of Chemical Technology, vol. 3, 4th Ed, pp. 765-833, 1993.

* cited by examiner

*Primary Examiner*—Timothy Edwards, Jr.
(74) *Attorney, Agent, or Firm*—Mark Nowotarski

(57) ABSTRACT

Swimmers are detected in a given body of water by dispersing sensors throughout the water column. The sensors adhere to the swimmer and reflect acoustic energy. Acoustic energy is broadcast in the water and the swimmer is detected by the characteristic motion of the sensors clinging to the swimmer as detected by acoustic monitors. The sensors may also fluoresce and be detectible by optical monitors when a portion of the swimmer is above the water.

10 Claims, 3 Drawing Sheets

SMART SENSOR SYSTEMS—SWIMMER DETECTION

CROSS-REFERENCE TO RELATED APPLICATION

This application is a divisional of U.S. nonprovisional patent application "Smart Polymeric Multilayer Sensors", Ser. No. 11/056,023, filed Feb. 11, 2005 now U.S. Pat. No. 7,345,596.

Said nonprovisional patent application Ser. No. 11/056,023 in turn claims the benefit of U.S. provisional patent application Ser. No. 60/543,953, filed Feb. 12, 2004, and entitled "Smart Polymeric Multilayer Sensors". Said provisional application Ser. No. 60/543,953, is incorporated herein by reference.

Said nonprovisional patent application Ser. No. 11/056,023 also claims the benefit of U.S. provisional patent application Ser. No. 60/599,141, filed Aug. 5, 2004, and entitled "Surface Swimmer Detection Via Sensors". Said provisional application Ser. No. 60/599,141, is incorporated herein by reference.

This application further incorporates by reference U.S. provisional patent application Ser. No. 60/455,142, filed Mar. 17, 2003, and entitled "Smart Polymeric Multilayer Sensors".

FIELD OF INVENTION

This invention is in the field of methods for detecting and tracking a swimmer.

BACKGROUND

An improved low cost method of detecting underwater and surface swimmers is needed.

SUMMARY OF THE INVENTION

The Summary of the Invention is provided as a guide to understanding the invention. It does not necessarily describe the most generic embodiment of the invention or all species of the invention disclosed herein.

The present invention comprises sensors that are in the form of multilayer polymer micro beads or other shapes and are about nanometers to millimeters in diameter. Said multilayer beads have a change in detectable property, such as color, density, buoyancy, or acoustic reflectivity, which occurs when exposed to a particular triggering stimulus. The change in said property is detectible by an external monitor.

DETAILED DESCRIPTION OF INVENTION

The following detailed description discloses various embodiments and features of the invention. These embodiments and features are meant to be exemplary and not limiting.

The present invention comprises sensors that are in the form of multilayer beads.

Figure 1:
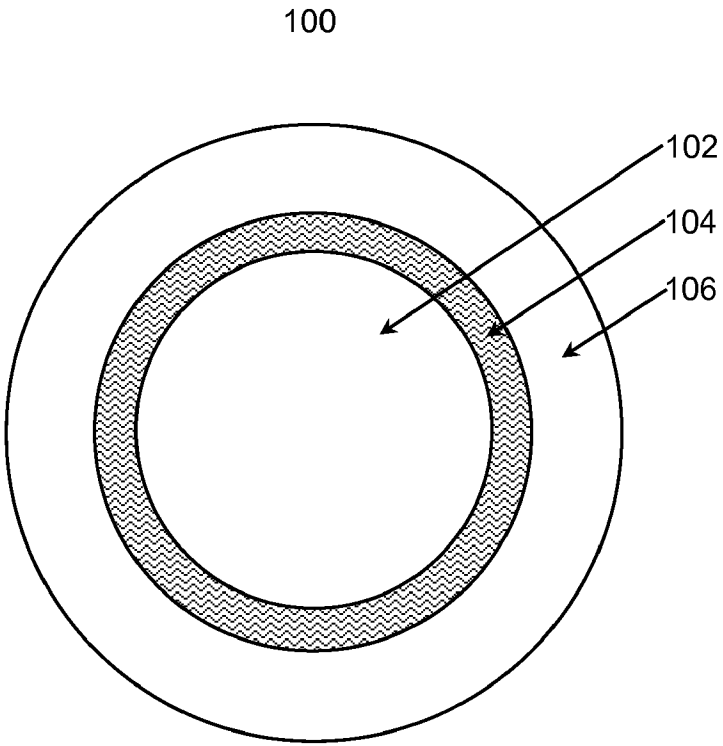
FIG. 1 is a cross section of a typical three-layer sensor bead.

FIG. 1 illustrates the cross section of a typical sensor structure. Sensor 100 is generally spherical in shape. The sensor comprises a core 102, intermediate layer 104 and outer layer 106.

Sensors may have an overall diameter in the range of a few nanometers to a few millimeters.

Sensors may also have nonspherical shapes, such as fabric swatches. Sensors may also be adhered to base film sheets.

Sensors may be distributed in large numbers in a given medium, such as air or water. When an object or chemical or physical effect disturbs said sensors, said sensors react and become detectible by a monitor. Hence the presence of said object, chemical or other physical effect may be detected.

Sensors are typically made from polymers. Suitable polymers depend upon the application. Suitable polymers include consumer, specialty, engineering, or high performance resins. Examples of suitable polymers include polyethylene, polypropylene, acrylics, vinyls, polyphenylene ether, and polyphenylene sulfide.

Biodegradable polymers such as poly(lactic acid) and aliphatic polyesters may also be used. Biodegradable polymers may be used so that sensors do not foul an ecosystem. Biodegradability can be from days to months depending on the microbe content of the medium that said sensors are distributed in.

Sensors may comprise metals. Said metals can be Fe, Cd, Se, Al, or Cu, mixtures thereof or other metals depending on the application. Metals can be employed as alloys, compounds, or in layered combination with polymers.

Sensors are typically core/shell in their morphological structure. They can also be other shapes or multilayer films. A shell can be coated onto a core. Alternatively, a core/shell can be polymerized as a core/shell structure.

Sensors may be made by known means for producing multilayer coatings. These known methods include the methods described in the Kirk-Othmer Encyclopedia of Chemical Technology, $4^{th}$ Edition, New York: Wiley, 1993, volume 6, pages 606 to 669. Said pages are incorporated herein by reference.

The core or intermediate layer of a sensor may exhibit luminescence, color change, change in acoustic reflectivity, electrical properties or other remotely detectible change in response to a specific triggering stimulus. The choice of which layer will be designed and formulated to respond to a given trigger is made depending on the application.

Depending on the application the outer layer can be a protective layer, reactive layer or shedding layer.

Sensors may be designed to be neutrally buoyant when distributed in a given fluid.

Sensors may comprise 1, 2, 3 or more layers wherein the core is considered to be a layer. The number of layers may depend upon the application. For example, Table 1 presents a number of applications of said sensors. Column 1 lists what is detected. Column 2 lists the number of layers in a sensor. Column 3 lists the information provided by the sensors.

TABLE 1

Sensor Applications

| Application | Layers in sensors | Information provided by sensor detection |
|---|---|---|
| Submarine | 2 or 3 | Detection of submarine<br>Tracking of submarine |
| Swimmer | 2 or 3 | Detection of swimmer<br>Increased acoustic range |

TABLE 1-continued

Sensor Applications

| Application | Layers in sensors | Information provided by sensor detection |
|---|---|---|
| Missile | 1 or 2 | Detection of missile<br>Tracking of missile |
| Wind Shear | 2 or 3 | Wind Intensity<br>Wind direction |
| Battlefield | 2 or 3 | Chemical agent<br>Biological agent<br>Dirty bomb |
| Shipping Container | 2 or 3 | Chemical agent<br>Biological agent<br>Dirty bomb |

The sensors may comprise a core, an intermediate layer and an outer layer. The overall size and density of the sensors is chosen so that the sensors disperse themselves uniformly over a given range of depths in a volume of water. Selected densities in the range of 1.015 to 1.035 g/cc are suitable.

The outer layer of said sensors has a density greater than said water. The combined core and intermediate layer have a density less than the water they are distributed in.

The intermediate layer further comprises luminescent or dye material. Suitable luminescent materials include inorganic and organic luminescent materials. Suitable inorganic luminescent materials include rare earth metal sulfides, such as AVeda™ pigments provided by United Mineral & Chemical Corp (Lyndhurst, N.J.). Suitable organic luminescent materials include Beaver Luminescent Pigments provided by Beaver Luminescers (Newton, Mass.).

IR luminescent dyes may be used when one wishes to detect while maintaining stealth. An IR laser would be used to interrogate sensors at the surface of said volume of water and an IR detector would be used to detect the luminescent emissions of any sensors that had floated to said surface.

Suitable thicknesses (diameter) for the core are in the range of 1 nm to 3,000 μm.

Suitable materials for the core include polylactic acid, biodegradable polyesters, and polyolefins (e.g., polyethylene, polypropylene).

The core may further comprise additives to reduce its density. Suitable additives include glass bubbles or hollow glass spheres. The glass spheres may have a diameter in the range of 1 to 500 microns. The density of the glass spheres may be in the range of 0.1 to 0.5 gm/cc. Suitable glass spheres include Scotchlite™ glass bubbles available from 3M company (St. Paul, Minn.).

Glass bubbles may also be added to the intermediate layer or outer layer to modify their respective densities.

The lower the density of the core, the faster the sensor will rise when the outer layer spalls off, depending upon the diameter of said sensor.

Density reducing agents may also be added to the intermediate layer.

The sensor may be designed such that at least a portion of both the intermediate layer and the outer layer spall off of the core when the sensor is subjected to shear forces. The luminant or dye material would then be in the core.

The outer layer and the intermediate layer may be a single layer. Similarly, the intermediate layer and the core may be a single layer. In each of these cases, the sensor would be a two-layer sensor.

Swimmer Detection

Figure 2:
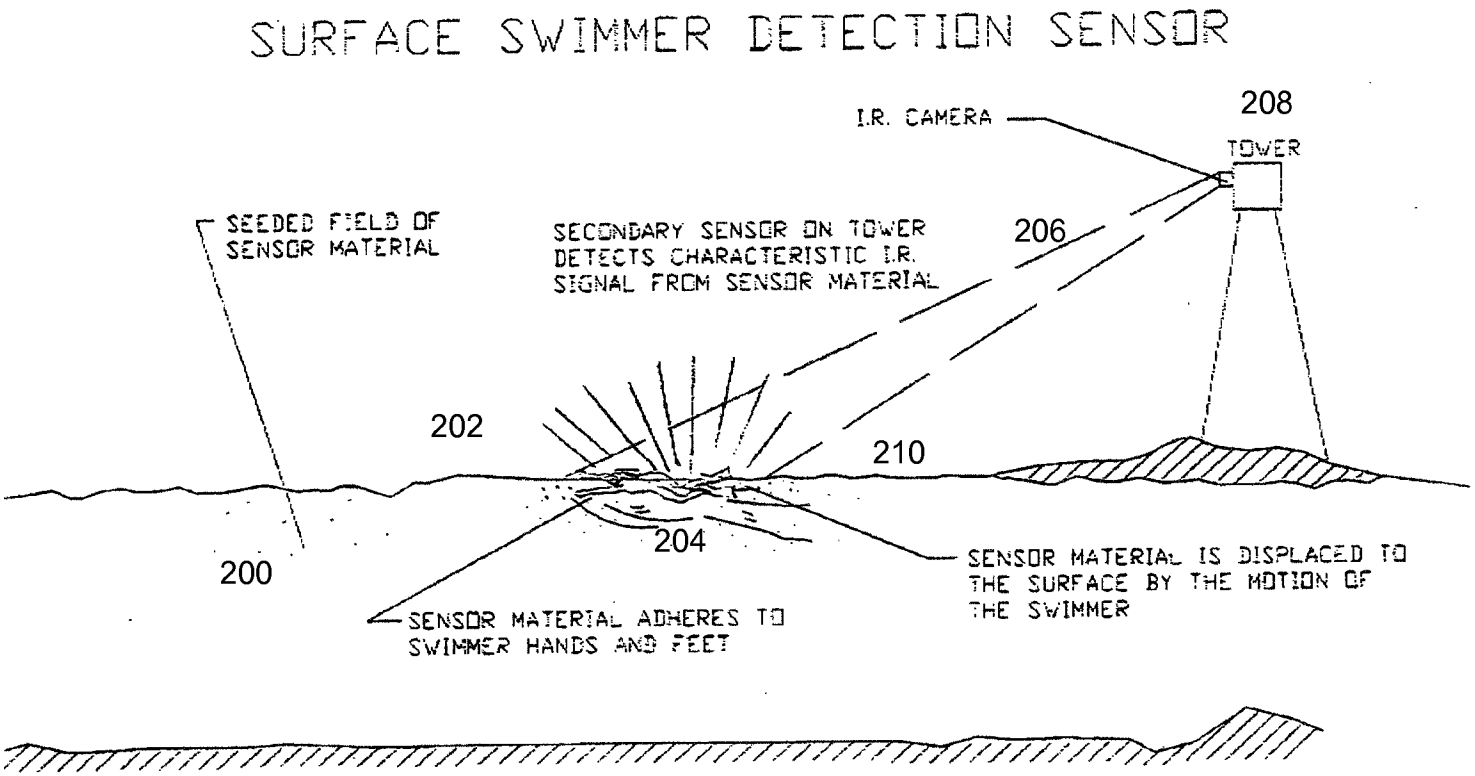
FIG. 2 illustrates the use of a field of sensors in swimmer detection.

FIG. 2 illustrates a method of swimmer detection using the inventive sensors. Similar methods can be used to detect surface water craft.

A multiplicity of sensors 200 are seeded in a volume of water 202. The sensors are deployed just below the surface of the water. The sensors may comprise three layers.

Table 2 presents a range of thicknesses of said layers that are suitable for swimmer tracking. Column 1 identifies the layer. Column 2 shows the range of suitable thicknesses. Column 3 shows the activity of the layer.

TABLE 3

Sensor Layers for Swimmer Detection and Tracking

| Layer | Thickness | Activity/Function |
|---|---|---|
| Overall sensor | 10 nm-5,000 μm | Detection of swimmer<br>Increased acoustic range |
| Outer layer | 1 nm-3,000 μm | Clear adhesive layer |
| Intermediate layer | 1 nm-3,000 μm | Luminant or acoustic reflective layer |
| Core | 1 nm-3,000 μm | Substrate |

A sensor may have a spherical shape with a diameter in the range of 100 nm to 10,000 μm.

A sensor may be flat shape. Said flat shape may be a square or rectangle with edge lengths in the range of 1 micron to 10 cm. The total thickness may be 15,000 μm or less.

A flat sensor may have a woven core structure.

A sensor comprises an outer layer. A suitable thickness of said outer layer is in the range of 100 nm to 2,500 μm.

Said outer layer may comprise an IR transparent adhesive. Said adhesive may comprise an epoxy, cyanoacrylate, phenolic or other water stable adhesive.

A sensor may comprise an intermediate layer. A suitable thickness for said intermediate layer is in the range of 100 nm to 5,000 μm.

Said intermediate layer may preferably comprise an IR fluorescent dye. Said intermediate layer may alternatively comprise UV fluorescent dyes.

Said outer layer adhesive should be thin enough and transparent enough at suitable frequencies of light so that said sensors will have detectible fluorescence when interrogated by a laser.

The sensor further comprises a core. The core is designed such that the sensors are neutrally buoyant with respect to water over a suitable range of depth.

A swimmer 204 that comes in contact with said sensors will have said sensors adhere to him/her.

The surface 210 of the water 202 may be interrogated by an IR laser 206 from an observation tower 208 or other suitable vantage point. When a sensor adheres to said swimmer, the IR fluorescence from the sensor is visible from said observation tower.

Said IR fluorescence may be observed using known means, such as SeaFLIR M® (available from FLIR Systems, Inc., Portland Oreg.), Cohu 2700™ (available from Cohu, Inc., San Diego, Calif.), Sony Block Camera™ (available from Erdman Video Systems, Miami, Fla.) or other suitable IR detection device.

Identification can be enhanced by analyzing said fluorescent signal to determine if there is motion characteristic of a swimmer. Said motion can be a periodicity in said signal. Said periodicity may have a characteristic frequency of kicking or arm motion.

EXAMPLE 1

It is a foggy night. A surface swimmer enters the port area of a submarine base. He comes in contact with neutrally buoyant adhesive coated sensors deployed ½ to 3 feet below the water surface. The sensors adhere to his body, hands, and feet. He does not notice this at first and continues swimming.

The sensors are spherical core/shell polymeric material about 4 mm in diameter with a clear transparent phenolic adhesive outer layer.

The intermediate layer comprises an IR luminescent spiked polyvinyl alcohol polymer.

The core is a biodegradable polymer.

The illuminating rays of an IR laser cycle over the port water area. Said rays are incident on the swimmer's hands and feet which intermittently break though the water's surface.

On illumination, the luminescent sensors sticking to the swimming intruder emit an IR signal which, even though it is a foggy night, are sensed by a Cohu 2700 camera located in a surveillance tower. The tower relays the information to a control area and sets off an alarm for security action.

EXAMPLE 2

It is a clear night. A surface swimmer in a wet suit enters the water adjacent to a nuclear power plant. He has a propulsion device.

His hands, body, and propulsion device come in contact with adhesive, neutrally buoyant sensors deployed from ½ to 3 feet below the surface. Each sensor is a dual coated nylon fabric about ½ inch square.

Each sensor comprises an outer layer. Said outer layer comprises a thin (~500 μm) clear transparent acrylic adhesive material. The adhesive sensors stick to the swimmer and said propulsion device.

Each sensor comprises an intermediate layer. Said intermediate layer is an IR activated luminescent spiked polyethylene polymer.

Illuminating rays of an IR lamp on a tower which covers the water area near said nuclear power plant are incident on said swimmer. As a result, said sensors emit an IR signal which is sensed by a sensitive IR camera located in a patrolling surface craft. Said patrolling surface craft then signals a security team who interdict said swimmer.

EXAMPLE 3

There is a morning fog. An underwater swimmer surfaces near a chemical plant. He comes in contact with sensors which are deployed in the water ½ to 4 feet below the surface. The sensors are adhesive and neutrally buoyant. They adhere to said swimmer's hands and feet which periodically break out from the surface in a swimmer's motion.

Said sensors are ⅝ inch wide by ¼ inch long coated polyester fabric.

Said sensors comprise an outer layer. Said outer layer comprises clear transparent cyanoacrylate adhesive.

Said sensors further comprise an intermediate layer. Said intermediate layer comprises a biodegradable polymer with dispersed IR pigment.

Illuminating rays from an IR lamp periodically flood said port area from a security tower. As a result the sensors adhering to said swimmer are periodically activated and emit an IR signal which is sensed by a Sony Block Camera in said tower.

A computerized signal algorithm confirms the presence of said swimmer via the characteristic motions of said IR emissions from his hands and feet as he moves through the water.

Security is called to the scene.

EXAMPLE 4

Figure 3:
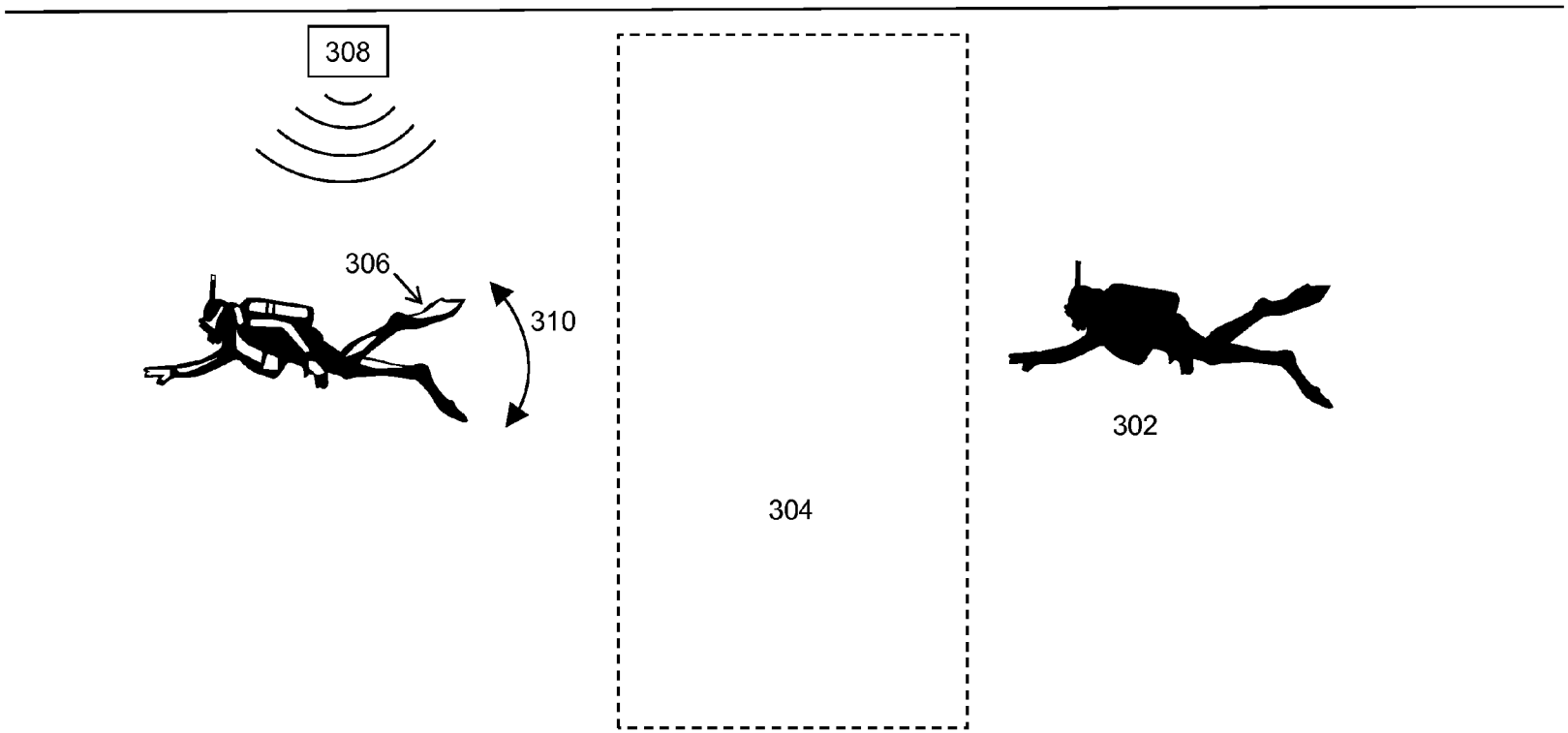
FIG. 3 illustrates the use of a field of acoustically reflective sensors in swimmer detection.

Referring to FIG. 3, an underwater swimmer 302 approaches a protected asset in a port area or in open water and senses an acoustic energy field in his/her area of the water. The swimmer simultaneously passes through a seeded field 304 of first sensors which adhere to him 306.

Said first sensors comprise an outer adhesive layer.

Said first sensors further comprise an intermediate layer. Said intermediate layer comprises metal or other acoustically reflective material.

An acoustic sensor 308 detects the characteristic swimmer's motion 310 of said first sensors thus indicating the presence of said swimmer.

The acoustic signal is extremely loud such that as said swimmer gets closer to its source, said swimmer experiences discomfort.

The swimmer quickly maneuvers to try to avoid both being detected and the acoustic discomfort and quickly comes up to the surface to escape the impinging acoustic energy.

However, there are second sensors deployed just below the surface which also adhere to said swimmer's hands and feet.

Said second sensors comprise an outer layer. Said outer layer is adhesive.

Said second sensors further comprise an intermediate layer. Said intermediate layer comprises a fluorescent dye.

The adhered second sensors emit a characteristic optical signal when interrogated by a laser beam from a surveillance boat. Said optical signal is detected by a sensor on said boat indicating that a swimmer has come to the surface.

Security people quickly engage the swimming intruder.

While particular embodiments of the present invention have been illustrated and described, it would be obvious to those skilled in the art that various other changes and modifications can be made without departing from the spirit and scope of the invention. Any of the aspects of the present invention found to offer advantages over the state of the art may be used separately or in any suitable combination to achieve some or all of the benefits of the invention disclosed herein.

I claim:

1. A method for detecting a swimmer in a first volume of water, said method comprising the steps of:

a) dispersing a plurality of first sensors in said first volume of water, said first sensors designed to:
   i. adhere to a swimmer passing through said first volume of water; and
   ii. reflect acoustical energy, b) broadcasting acoustic energy in said first volume of water, said acoustic energy having sufficient strength to cause at least discomfort in a swimmer;

c) monitoring said first volume of water with an acoustic detector to detect acoustic energy reflected off said first sensors;

d) analyzing the detected acoustic energy reflected off of said first sensors to identify the characteristic motion of a swimmer; and e) triggering a first alarm if said analysis identifies the characteristic motion of a swimmer.

2. The method of claim 1 which further comprises the steps of:

a) dispersing a plurality of second sensors in a second volume of water, said second sensors designed to:

i. adhere to a swimmer passing through said second volume of water; and ii. fluoresce when interrogated by an optical signal, b) broadcasting acoustic energy in said first volume of water, said acoustic energy having sufficient strength to cause a swimmer to move from said first volume of water to said second volume of water;

c) monitoring the surface of said second volume of water with a laser and luminescence detector to detect luminescent emissions from said second sensors;

d) analyzing said luminescent emissions to identify the characteristic motion of a swimmer; and e) triggering a second alarm if said analysis of said luminescent emissions identifies the characteristic motion of a swimmer.

3. The method of claim 2 wherein said second sensors are distributed from between ½ and 3 feet below the surface of said water.

4. The method of claim 1 wherein one or more of said sensors has a thickness of 5,000 microns or less.

5. The method of claim 1 wherein one or more of said sensors comprises an outer layer and wherein said outer layer has a thickness in the range of 1 nanometer to 3000 microns and wherein said outer layer comprises an adhesive.

6. The method of claim 1 wherein one or more of said sensors comprises an intermediate layer and wherein said intermediate layer has a thickness in the range of 1 nanometers to 3000 microns and wherein said intermediate layer comprises luminant or acoustic reflective layer.

7. The method of claim 1 wherein one or more of said sensors comprises a core and wherein said core has a thickness in the range of 1 nanometers to 3000 microns.

8. The method of claim 1 wherein the core of said sensors is designed such that said sensors are neutrally buoyant over a range of depths of water.

9. The method of claim 1 wherein said sensors increase the acoustic dectability of said swimmer when they adhere to said swimmer.

10. The method of claim 1 wherein said first volume of water is selected such that a swimmer must pass through said volume of water in order to get to a target.

* * * * *